US010581202B2

(12) United States Patent
Xu et al.

(10) Patent No.: US 10,581,202 B2
(45) Date of Patent: Mar. 3, 2020

(54) ELECTRICAL CONNECTOR WITH IMPEDANCE ADJUSTMENT

(71) Applicant: FOXCONN INTERCONNECT TECHNOLOGY LIMITED, Grand Cayman (KY)

(72) Inventors: Yin-Chao Xu, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/125,776

(22) Filed: Sep. 10, 2018

(65) Prior Publication Data

US 2019/0103709 A1 Apr. 4, 2019

(30) Foreign Application Priority Data

Sep. 29, 2017 (CN) ..... 2017 1 0907963

(51) Int. Cl.

| | |
|---|---|
| ***H01R 24/60*** | (2011.01) |
| ***H01R 13/6474*** | (2011.01) |
| ***H01R 13/6461*** | (2011.01) |
| ***H01R 13/6585*** | (2011.01) |
| *H01R 107/00* | (2006.01) |
| *H01R 13/6597* | (2011.01) |

(52) U.S. Cl.

CPC ..... *H01R 13/6474* (2013.01); *H01R 13/6461* (2013.01); *H01R 13/6585* (2013.01); *H01R 13/6597* (2013.01); *H01R 24/60* (2013.01); *H01R 2107/00* (2013.01)

(58) Field of Classification Search

CPC .... G06F 3/1292; G06F 3/1236; G06F 3/1204; G06F 3/1296; G06F 3/1237; G06F 3/1285; H04W 4/80; H04L 67/34; H04B 5/0031

See application file for complete search history.

(56) References Cited

U.S. PATENT DOCUMENTS

| | | | | |
|---|---|---|---|---|
| 5,630,738 A * | 5/1997 | Ito | H01R 13/113 439/851 |
| 5,899,764 A * | 5/1999 | Harting | H01R 13/7032 200/51.1 |
| 6,095,873 A * | 8/2000 | Muramatsu | H01R 13/113 439/852 |
| 6,116,970 A * | 9/2000 | Yamamoto | H01R 13/113 439/852 |

(Continued)

FOREIGN PATENT DOCUMENTS

| | | |
|---|---|---|
| CN | 102195173 B | 6/2015 |
| TW | M332989 | 5/2008 |
| TW | I578641 B | 4/2017 |

*Primary Examiner* — Truc T Nguyen

(74) *Attorney, Agent, or Firm* — Wei Te Chung; Ming Chieh Chang

(57) ABSTRACT

An electrical connector includes an insulative housing and a plurality of contacts retained in the housing. The housing includes a base and a tongue portion extending forwardly from the base and forming opposite mating surfaces thereon. The contact includes a contacting section having an exterior face exposed upon the corresponding mating surface in a coplanar manner, and an interior face opposite to the exterior face with a recess therein.

20 Claims, 9 Drawing Sheets

(56) References Cited

U.S. PATENT DOCUMENTS

| | | | | |
|---|---|---|---|---|
| 7,470,159 | B2 * | 12/2008 | Hara | H01R 13/113<br>439/595 |
| 7,918,680 | B2 * | 4/2011 | Schapira | H01R 33/0809<br>439/338 |
| 9,520,683 | B2 * | 12/2016 | Qian | H01R 13/6585 |
| 9,705,243 | B1 * | 7/2017 | McCracken | H01R 13/6205 |
| 9,705,263 | B2 * | 7/2017 | Huang | H01R 13/7175 |
| 10,027,043 | B2 * | 7/2018 | Zhang | H01R 12/7064 |
| 10,027,066 | B2 * | 7/2018 | Zhong | H01R 13/6597 |
| 10,270,192 | B2 * | 4/2019 | Huang | H01R 13/7172 |
| 2006/0252294 | A1 * | 11/2006 | Cvasa | H01R 13/187<br>439/252 |

* cited by examiner

ELECTRICAL CONNECTOR WITH IMPEDANCE ADJUSTMENT

BACKGROUND OF THE DISCLOSURE

1. Field of the Disclosure

The present disclosure relates to an electrical connector, and more particularly to an electrical connector with impedance adjustment around the contacting section.

2. Description of Related Arts

U.S. patent Ser. No. 10/027,043 discloses an electrical connector including an insulative housing, a plurality of contacts retained in the housing, and metallic shell attached upon the housing. The housing includes a base and a tongue portion extending forwardly from the base. The contact includes a contacting section thicker than other portions, thus making the impedance change thereabouts.

An improved electrical connector with proper impedance is desired.

SUMMARY OF THE DISCLOSURE

An electrical connector includes an insulative housing and a plurality of contacts retained in the housing. The housing includes a base and a tongue portion extending forwardly from the base and forming opposite mating surfaces thereon. The contact includes a contacting section having an exterior face exposed upon the corresponding mating surface in a coplanar manner, and an interior face opposite to the exterior face with a recess therein.

The contacts are arranged in two rows. A metallic shielding plate is embedded within the housing and between the two rows. The metallic shielding plate is recessed corresponding to the contacting sections.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
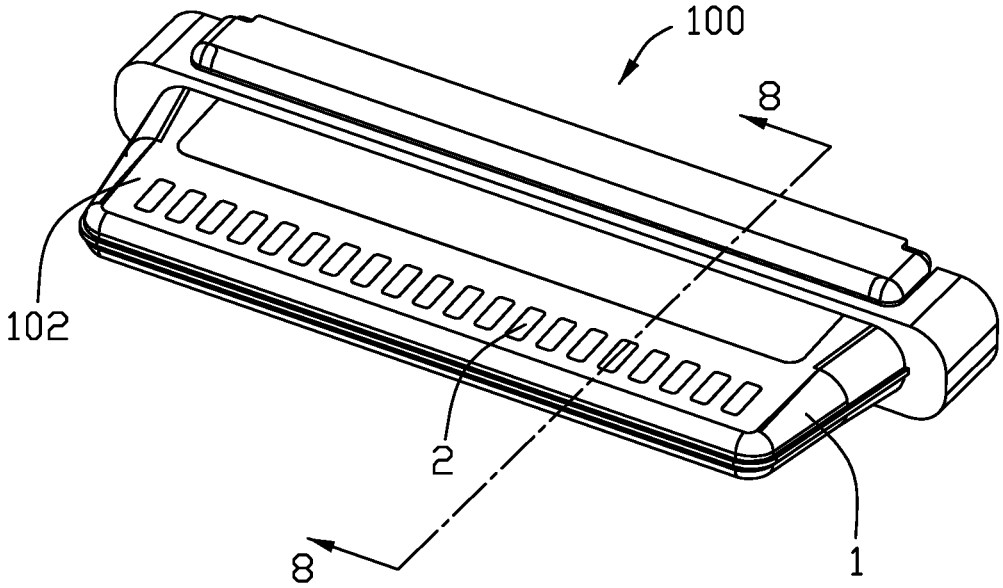
FIG. 1 is a front perspective view of an electrical connector according to the invention.
Figure 2:
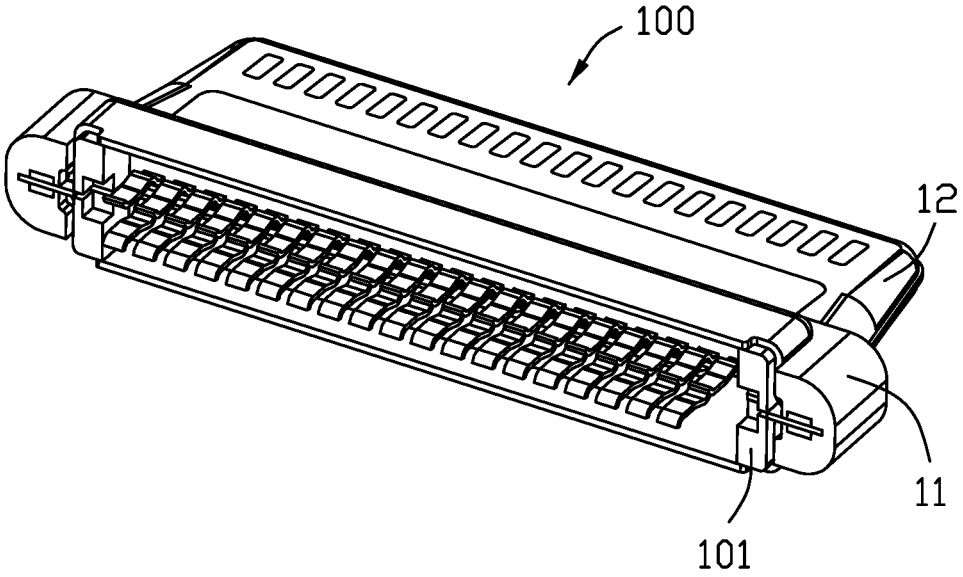
FIG. 2 is a rear perspective view of the electrical connector of FIG. 1.
Figure 3:
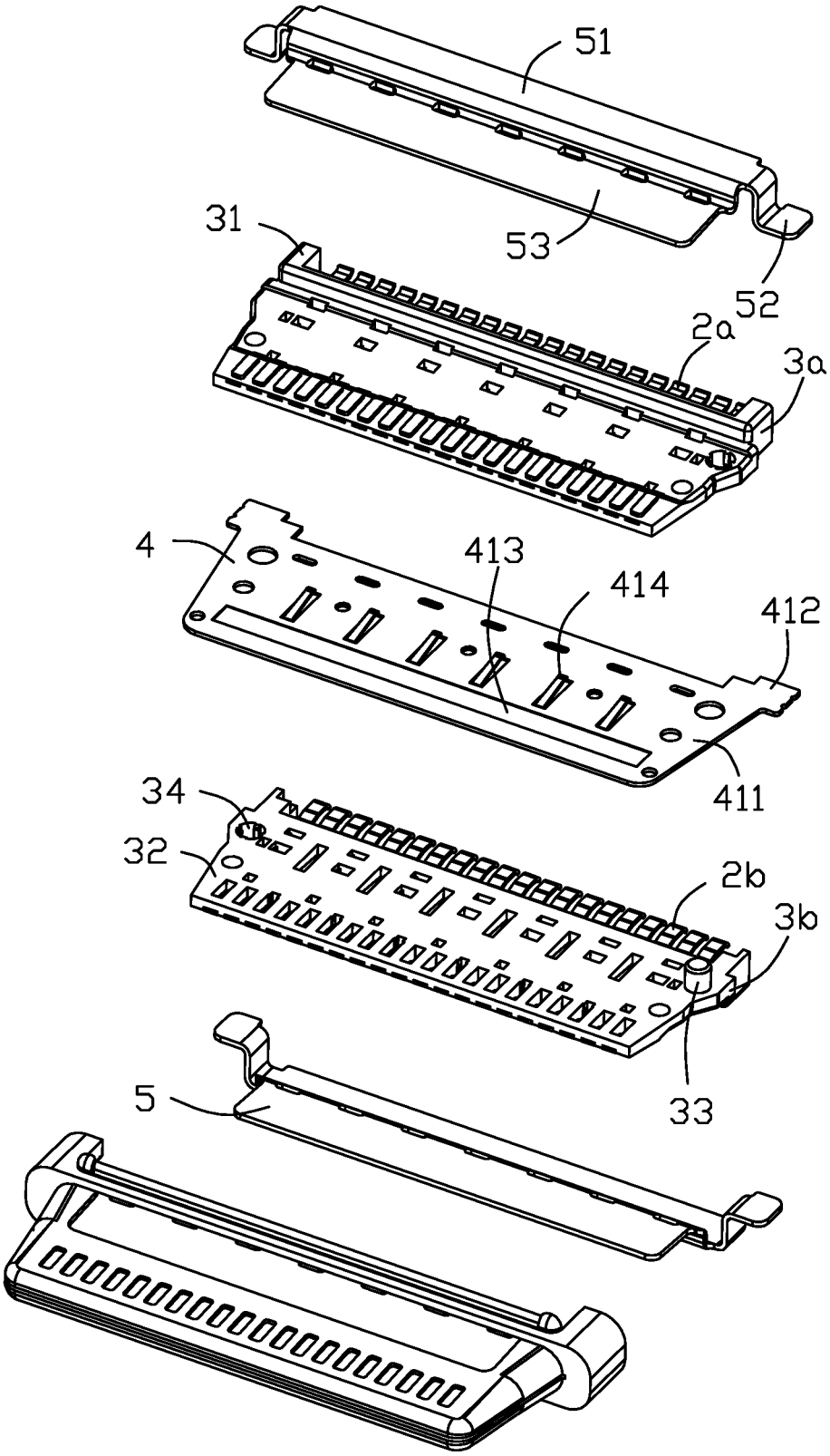
FIG. 3 is a front exploded perspective view of the electrical connector of FIG. 1.
Figure 4:
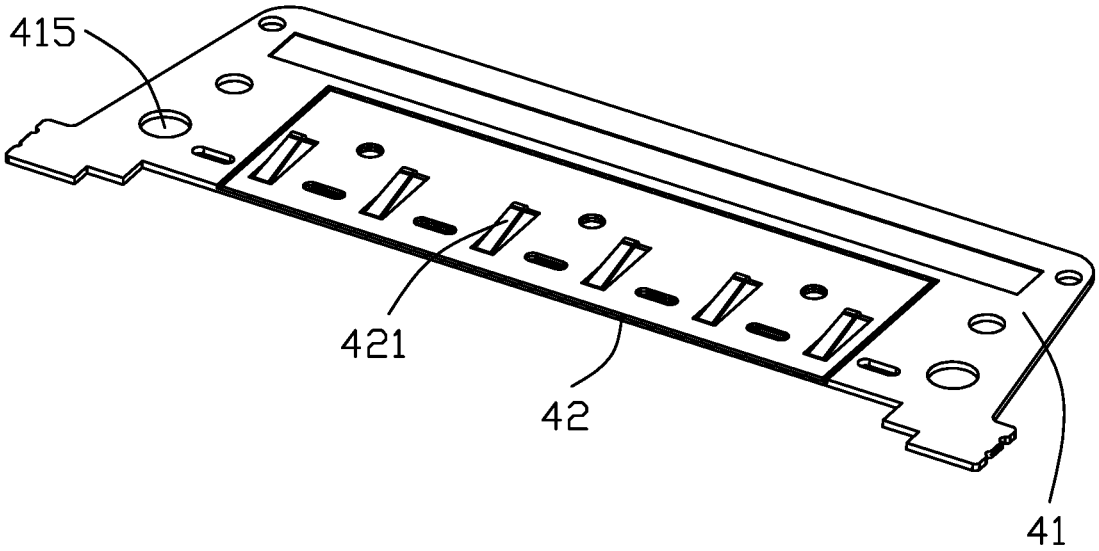
FIG. 4 is a rear assembled perspective view of the shielding plate of the electrical connector of FIG. 3
Figure 4A:
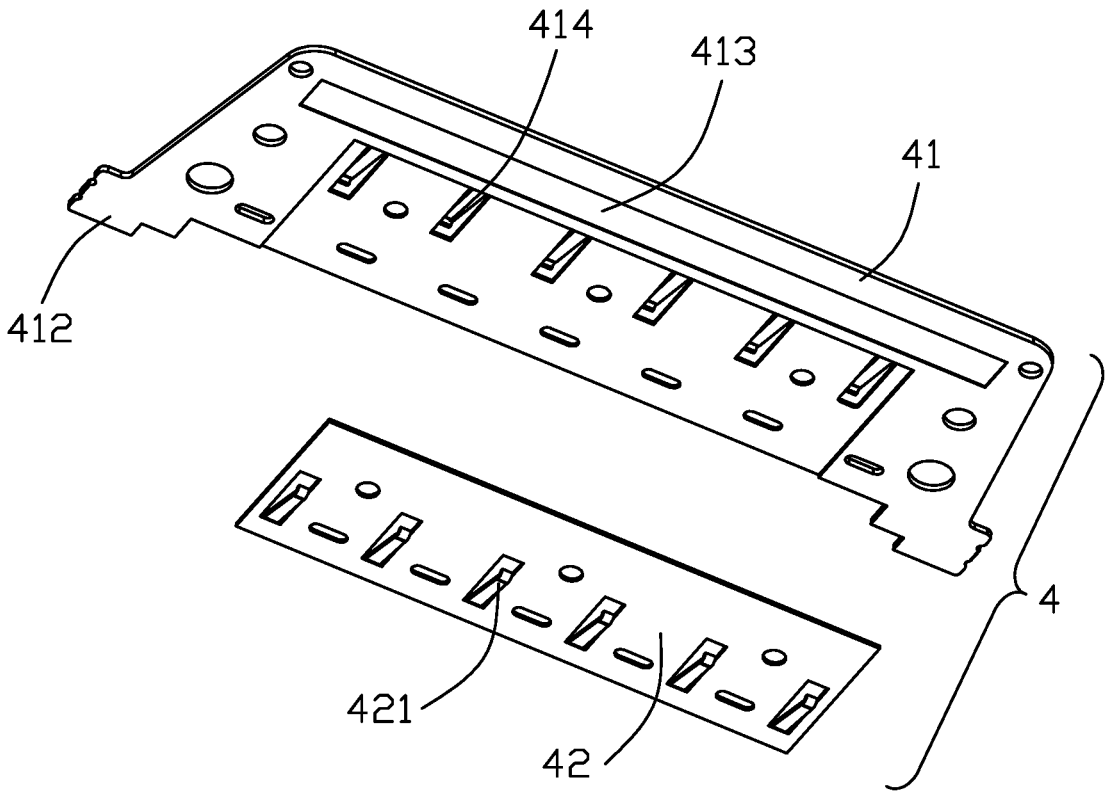
FIG. 4(A) is a rear exploded perspective view of the shielding plate set of the electrical connector of FIG. 4.
Figure 5:
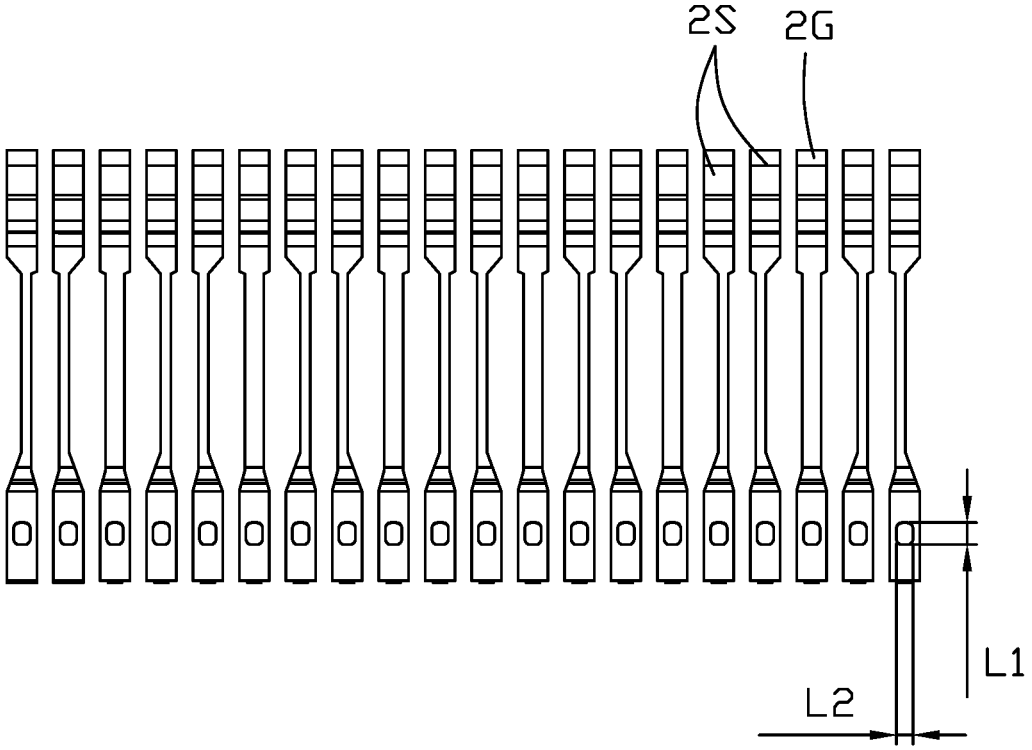
FIG. 5 is an elevation view of the contacts of the electrical connector of FIG. 1.
Figure 6:
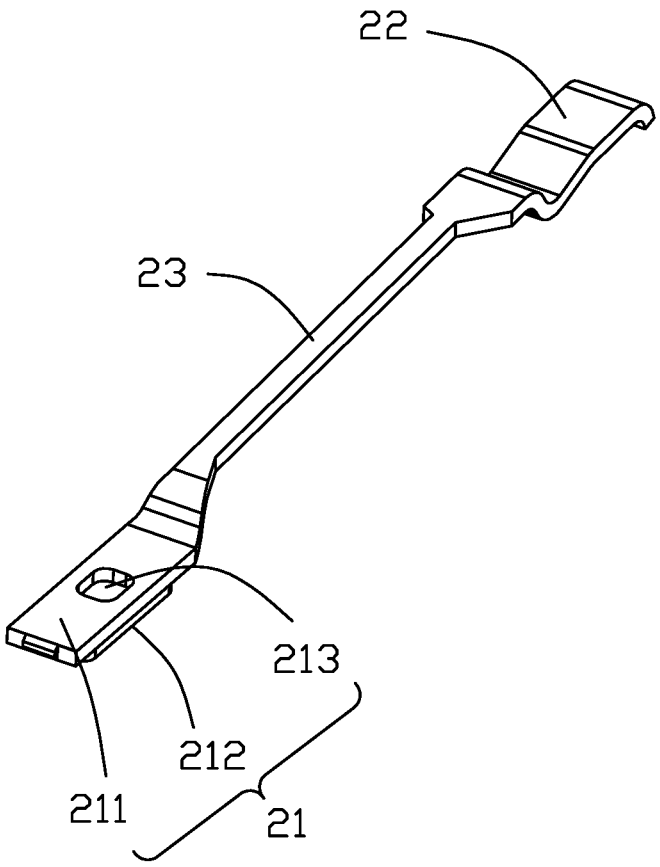
FIG. 6 is a perspective view of the contact of the electrical connector of FIG. 5.
Figure 7:
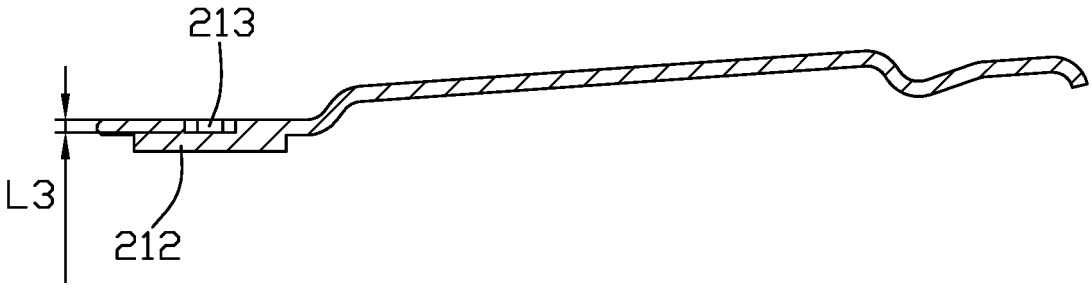
FIG. 7 is a cross-sectional view of the contact of the electrical connector of FIG. 6.
Figure 8:
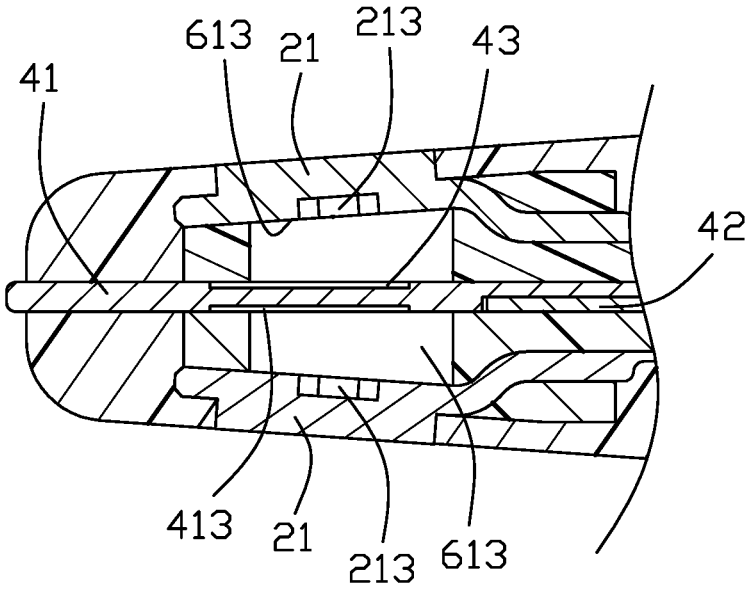
FIG. 8 is an enlarged cross-sectional view of a front portion of the electrical connector of FIG. 1.

Reference will now be made in detail to the embodiments of the present disclosure. The embodiment is shown in FIGS. 1 to 8. An electrical connector 100 includes an insulative housing 1 and a plurality of contacts 2 attached to the housing 1. The hosing 1 includes a base 11 and a tong portion 12 forwardly extending from the base 11 along a front-to-back direction. The base 11 forms a rear end face 101 while the tongue portion 12 forms two opposite mating faces 102. Notably, the mating face 102 is exposed to an exterior in roughly a vertical direction while being precisely in a slanted direction for easy insertion within a corresponding complementary connector (not shown).

The contacts 2 includes a first row of contacts 2*a* and a second row of contacts 2*b* spaced from each other in a vertical direction perpendicular to the front-to-back direction, and each row of the first row of contacts 2*a* and the second row of contacts 2*b* spans in a transverse direction perpendicular to both the front-to-back direction and the vertical direction. The housing 1 includes a first insulator 3*a* integrally formed with the first row of contacts 2*a* via an insert-molding process, and a second insulator 3*b* integrally formed with the second row of contacts 2*b* via another insert-molding process. Each of the first insulator 3*a* and the second insulator 3*b* includes a main body 31 and a mating tongue 32 extending forwardly from the main body 31. The mating tongue 32 of each of the first insulator 3*a* and the second insulator 3*b* forms both the positioning post 33 and the positioning hole 34.

A shielding plate set 4 is sandwiched between the first insulator 3*a* and the second insulator 3*b* in the vertical direction. The shielding plate set 4 includes a main plate 41 and an auxiliary plate 42. The main plate 41 include a main part 411 and a pair of legs 412 on two lateral sides of the main part 411. A pair of recessions 413 are respectively formed in opposite surfaces of the main part 411. The main part 411 forms a plurality of spring tangs 414 extending toward the first row of contacts 2*a* with the corresponding punched holes (not labeled) for contacting the corresponding grounding contacts of the first row of contacts 2*a*. The main part 411 forms, corresponding to the spring tangs 414, a thinned area in which the auxiliary plate 42, which is essentially of one half thickness the regular area of the is received. Notably, the recessions 413 are located in front of the thinned area. The auxiliary plate 42 forms a plurality of spring fingers 421 with the corresponding punched holes (not labeled) for contacting the grounding contacts 2G of the second row of contacts 2*b*. The spring tangs 414 and the spring fingers 421 are offset from each other in the front-to-back direction so as not to expose the corresponding punched holes in the vertical direction. The relative structures of the combo type shielding plate set 4 can be referred to the copending application Ser. No. 16/105,954 filed on Aug. 20, 2018. The main part 411 has a pair of through holes 415 through which the corresponding positioning post 33 extends to be received within the corresponding positioning hole 34 so as to have the first insulator 3*a*, the shielding plate set 4 and the second insulator 3*b* fastened together.

The connector 100 further includes a pair of metallic shells 5 respectively mounted upon the first insulator 3*a* and the second insulator 3*b*. The shell 5 includes a planar section 51, a pair of mounting legs 52 extending from two opposite ends of the planar section 51 to contact the corresponding legs 412 of the main plate 41, respectively, and an extension 53 forwardly extending from the planar section 51. The housing 1 is further applied upon the shells 5, the first insulator 3*a* and the second insulator 3*b* to form the complete connector 100 wherein the planar section 51 is exposed upon the base 11, and the extension 53 is exposed upon the mating face 102 in a coplanar manner.

Each row of the first row of contacts 2*a* and the second row of contacts 2*b* includes a plurality of grounding contacts 2G and a plurality of differential pair signal contacts 2S alternately arranged with each other along the transverse direction. Each contact 2 includes a contacting section 21 exposed upon the corresponding mating face 102, a tail section 22 extending out of the rear end face 101, and the connecting section 23 linking the contacting section 21 and the tail section 23. Along the transverse direction, a width of the connecting section 23 is smaller than those of both the contacting section 21 and the tail section 23. The width of the connecting section 23 of the differential pair signal contact 2S is smaller than that of the connecting section 23 of the grounding contact 2G wherein the former is around 0.16 mm to 0.20 mm while the latter is around 0.32 mm to 0.36 mm. In this embodiment, the former is 0.18 mm and the latter is 0.34 mm Because of this width difference between the grounding contact 2G and the differential pair signal contact 2S, the impedance is properly adjusted.

The contacting section 21 includes a plate 211 and a protrusion 212 thereon. The protrusion 212 has an exterior surface (not labeled) exposed upon the corresponding mating face 102 in a coplanar manner, and a recess 213 formed in an interior surface (not labeled) opposite to the exterior surface. Such a recess is made to adjust the corresponding impedance wherein along the transverse direction, the width of the recess 213 is smaller than the aforementioned width of the connecting section 23 of the grounding contact 2G while being larger than the aforementioned width of the connecting section 23 of the differential pair signal contact 2S. In this embodiment, the recess 213 is rectangular and is positioned in a center region of the contacting section 21 in both the front-to-back direction and the transverse direction. In this embodiment, the four corners of the recess are curved, and is dimensioned with 0.4 mm along the front-to-back direction and 0.3 mm along the transverse direction and 0.1 mm in the vertical direction, i.e., the depth of the recess 213. Understandably, other shapes of the recess 213 may be workable instead. In this embodiment, the thickness of the protrusion 212 is similar to or slightly larger than that of the plate 211 while the depth of the recess 213 is smaller than the thickness of the plate 211, In brief, in the instant invention the contacting section 21 of the contact 2 forms the hidden recess 213 to adjust the impedance, and further with the recess 413 in the shielding plate set 4 corresponding to the contacting section 21 and the associated recess 213 in the contacting section 21 in the vertical direction so as to avoid improper crosstalk among the shielding plate set 4, the differential pair signal contacts 2S and the grounding contacts 2G Optimally, the recess 213 faces an empty space 613 between the shielding plate set 4 and the contacting section 21 in the vertical direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base and tongue portion extending forwardly from the base in a front-to-back direction and forming opposite mating faces thereon;

a plurality of contacts retained in the housing and arranged in first and second rows in a vertical direction perpendicular to the front-to-back direction, each of said first row and said second row spanning in a transverse direction perpendicular to both the front-to-back direction and the vertical direction, each of the contacts including a contacting section, a tail section and a connecting section therebetween in the front-to-back direction;

said contacting section of each contact including a plate embedded within the housing, and a protrusion unitarily formed on the plate; wherein said protrusion defines opposite exterior surface and interior surface opposite to each other, said exterior surface being exposed to on the mating face in a coplanar manner and the plate forms a recess in the interior surface.

2. The electrical connector as claimed in claim 1, wherein in the vertical direction a depth of the recess is smaller than a thickness of the plate.

3. The electrical connector as claimed in claim 1, wherein in the vertical direction a thickness of the protrusion is not less that of the plate.

4. The electrical connector as claimed in claim 1, wherein a thickness of the connecting section and that of the tail section is same with that of the plate.

5. The electrical connector as claimed in claim 1, further including a metallic shielding plate set between the first row and the second row in the vertical direction, wherein the shielding plate set forms a pair of recessions aligned with the contacting sections and the associated recesses of the contacts in the vertical direction.

6. The electrical connector as claimed in claim 5, wherein the housing includes a first insulator integrally formed with the contacts in the first row, and a second insulator integrally formed with the contacts in the second row, and the shielding plate set is sandwiched between the first insulator and the second insulator.

7. The electrical connector as claimed in claim 6, wherein the shielding plate set forms a plurality of spring tangs mechanically and electrically connecting to the contacting sections of corresponding grounding contacts in the first row, and a plurality of spring fingers mechanically and electrically connecting to the contacting sections of corresponding grounding contacts in the second row, both said spring tangs and said spring fingers located behind the recessions in the front-to-back direction.

8. The electrical connector as claimed in claim 1, wherein the contacts include a plurality of grounding contacts and a plurality of differential pair signal contacts alternately arranged with each other along the transverse direction, the connecting section of each grounding contact being larger than that of the differential pair signal contact, and in the transverse direction a dimension of the recess being larger than that of the connecting section of the signal contact while smaller than that of the connecting section of the grounding contact.

9. The electrical connector as claimed in claim 8, wherein in each contact, in the transverse direction a width of the connecting section is smaller than those of both the contacting section and the tail section.

10. An electrical connector comprising:

an insulative housing including a base and tongue portion extending forwardly from the base in a front-to-back direction and forming opposite mating faces thereon;

a plurality of contacts retained in the housing and arranged in first and second rows spaced from each other in a vertical direction perpendicular to the front-to-back direction, each of said first row and said second row spanning in a transverse direction perpendicular to both the front-to-back direction and the vertical direction, each of the contacts including a contacting section, a tail section, and a connecting section therebetween in the front-to-back direction;

a metallic shielding plate set being located between the first row and the second row in the vertical direction;

said contacting section of each contact including a plate embedded within the housing, and a protrusion unitarily formed on the plate and exposed upon the corresponding mating face so as to have a thickness of the contacting section larger than those of both the connecting section and the tail section; wherein the shielding plate set forms a pair of recessions in two opposite surfaces thereof in alignment with the contacting sections of the contacts in said first row and second row, respectively, in the vertical direction.

11. The electrical connector as claimed in claim 10, wherein the contacting section of each contact further includes a recess therein for impedance adjustment.

12. The electrical connector as claimed in claim 11, wherein the recess is hidden behind an interior surface of the contacting section of each contact in the vertical direction.

13. The electrical connector as claimed in claim 12, wherein said contacts in each row includes a plurality of grounding contacts and a plurality of differential pair signal contacts alternately arranged with each other in the transverse direction, and in the transverse direction a width of the connecting section of the grounding contact is larger than that of signal contact.

14. The electrical connector as claimed in claim 13, wherein in the transverse direction a width of the recess is smaller than that of the connecting section of the grounding contact while being larger than that of the connecting section of the signal contact.

15. The electrical connector as claimed in claim 14, wherein in the vertical direction, a depth of the recess is smaller than a thickness of the plate.

16. An electrical connector comprising:

an insulative housing including a base and tongue portion extending forwardly from the base in a front-to-back direction and forming thereon at least one mating face exposed to an exterior in a vertical direction perpendicular to the front-to-back direction;

a plurality of contacts retained in the housing and arranged at least in one row spanning in a transverse direction perpendicular to the front-to-back direction, each of the contacts including a contacting section, a tail section, and a connecting section therebetween in the front-to-back direction;

said contacting section of each contact including a plate embedded within the housing, and a protrusion unitarily formed on the plate and exposed on the corresponding mating face so as to have a thickness of the contacting section larger than those of both the connecting section and the tail section; wherein a recess is formed in the contacting section of each contact, and in a top view said protrusion is dimensionally larger than the recess while smaller than the plate in both the front-to-back direction and the transverse direction.

17. The electrical connector as claimed in claim 16, wherein said recess is formed in an interior surface of the plate in a hidden manner.

18. The electrical connector as claimed in claim 17, wherein in the vertical direction a depth of the recess is smaller than a thickness of the plate.

19. The electrical connector as claimed in claim 17, wherein said recess is rectangular.

20. The electrical connector as claimed in claim 17, wherein the recess faces an empty space between the contacting section and a shielding plate set embedded within the housing.

* * * * *